US009380394B2

(12) United States Patent
Krystek et al.

(10) Patent No.: US 9,380,394 B2
(45) **Date of Patent: *Jun. 28, 2016**

(54) SMART HEARING AID

(71) Applicant: INTERNATIONAL BUSINESS MACHINES CORPORATION, Armonk, NY (US)

(72) Inventors: Paul N. Krystek, Highland, NY (US); Mark B. Stevens, Austin, TX (US); John D. Wilson, Houston, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/486,665

(22) Filed: Sep. 15, 2014

(65) Prior Publication Data

US 2015/0181357 A1 Jun. 25, 2015

Related U.S. Application Data

(63) Continuation of application No. 14/135,537, filed on Dec. 19, 2013.

(51) Int. Cl.
*H04R 25/00* (2006.01)

(52) U.S. Cl.
CPC ..... *H04R 25/558* (2013.01); *H04R 25/305* (2013.01); *H04R 25/554* (2013.01); *H04R 25/70* (2013.01); *H04R 2225/39* (2013.01); *H04R 2225/41* (2013.01); *H04R 2430/01* (2013.01); *H04R 2460/03* (2013.01)

(58) Field of Classification Search
CPC .... H04R 25/00; H04R 25/505; H04R 25/507; H04R 2225/39; H04R 2225/41
See application file for complete search history.

(56) References Cited

U.S. PATENT DOCUMENTS

| | | | | |
|---|---|---|---|---|
| 5,636,285 | A | 6/1997 | Sauer | |
| 6,913,578 | B2 | 7/2005 | Hou | |
| 7,522,739 | B2 | 4/2009 | Rass et al. | |
| 7,881,487 | B2 | 2/2011 | Dickel et al. | |
| 8,094,848 | B1 | 1/2012 | Frerking et al. | |
| 8,503,703 | B2 | 8/2013 | Eaton et al. | |
| 8,532,317 | B2 | 9/2013 | Dilon et al. | |
| 2004/0190738 | A1* | 9/2004 | Meier | H04R 25/505 381/312 |
| 2004/0208331 | A1* | 10/2004 | Chalupper | H04R 25/70 381/314 |
| 2005/0129262 | A1* | 6/2005 | Dillon | A61N 1/36032 381/312 |
| 2006/0222194 | A1* | 10/2006 | Bramslow | H04R 25/305 381/314 |
| 2007/0076909 | A1* | 4/2007 | Roeck | H04R 25/70 381/312 |
| 2007/0081682 | A1 | 4/2007 | Dickel et al. | |
| 2008/0292122 | A1* | 11/2008 | Nordahn | H04R 25/356 381/321 |
| 2010/0040247 | A1* | 2/2010 | Ypma | H04R 25/505 381/314 |
| 2010/0202637 | A1* | 8/2010 | Cornelisse | H04R 25/70 381/314 |
| 2014/0146986 | A1* | 5/2014 | Ypma | H04R 25/505 381/314 |

* cited by examiner

*Primary Examiner* — Matthew Eason
(74) *Attorney, Agent, or Firm* — Paul S. Drake

(57) ABSTRACT

A method for controlling a hearing aid based on an adjustable policy including receiving an input signal; receiving an indication signal from a user identifying the input signal; receiving an adjustment to the hearing aid with the indication signal; and utilizing a processor to store the input signal in memory with the adjustment to the hearing aid as an adjustable policy corresponding to the input signal.

8 Claims, 8 Drawing Sheets

SMART HEARING AID

This application is a continuation of application Ser. No. 14/135,537 filed Dec. 19, 2013 entitled "SMART HEARING AID", the disclosure of which is incorporated in its entirety herein by reference.

BACKGROUND

1. Technical Field

The present invention relates generally to a smart hearing aid, and in particular, to a computer implemented method for controlling a hearing aid based on an adjustable policy.

2. Description of Related Art

Hearing deficiencies affect a large percentage of the population. Hearing aids have been developed to compensate for hearing loss in individuals. Hearing aids can provide a great benefit to a wide range of persons with hearing deficiencies. Hearing aids come in many forms from behind the ear type to a molded hearing aid placed in the ear canal. Each of these types has several advantages and disadvantages over the other type.

Wearers of hearing aids live in a wide variety of circumstances. Some wearers may live in an urban environment with many background noises and others in more suburban or rural environments. Some wearers live in a small family or have a large family with many daily interactions and distractions. As a result, each person has different circumstances and needs with their hearing aids.

SUMMARY

The illustrative embodiments provide a method for controlling a hearing aid based on an adjustable policy including receiving an input signal; receiving an indication signal from a user identifying the input signal; receiving an adjustment to the hearing aid with the indication signal; and utilizing a processor to store the input signal in memory with the adjustment to the hearing aid as an adjustable policy corresponding to the input signal.

BRIEF DESCRIPTION OF THE SEVERAL VIEWS OF THE DRAWINGS

The novel features believed characteristic of the invention are set forth in the appended claims. The invention itself, further objectives and advantages thereof, as well as a preferred mode of use, will best be understood by reference to the following detailed description of illustrative embodiments when read in conjunction with the accompanying drawings, wherein:

DETAILED DESCRIPTION

Processes and devices may be implemented and utilized for controlling a hearing aid based on an adjustable policy. These processes and apparatuses may be implemented and utilized as will be explained with reference to the various embodiments below.

Figure 1:
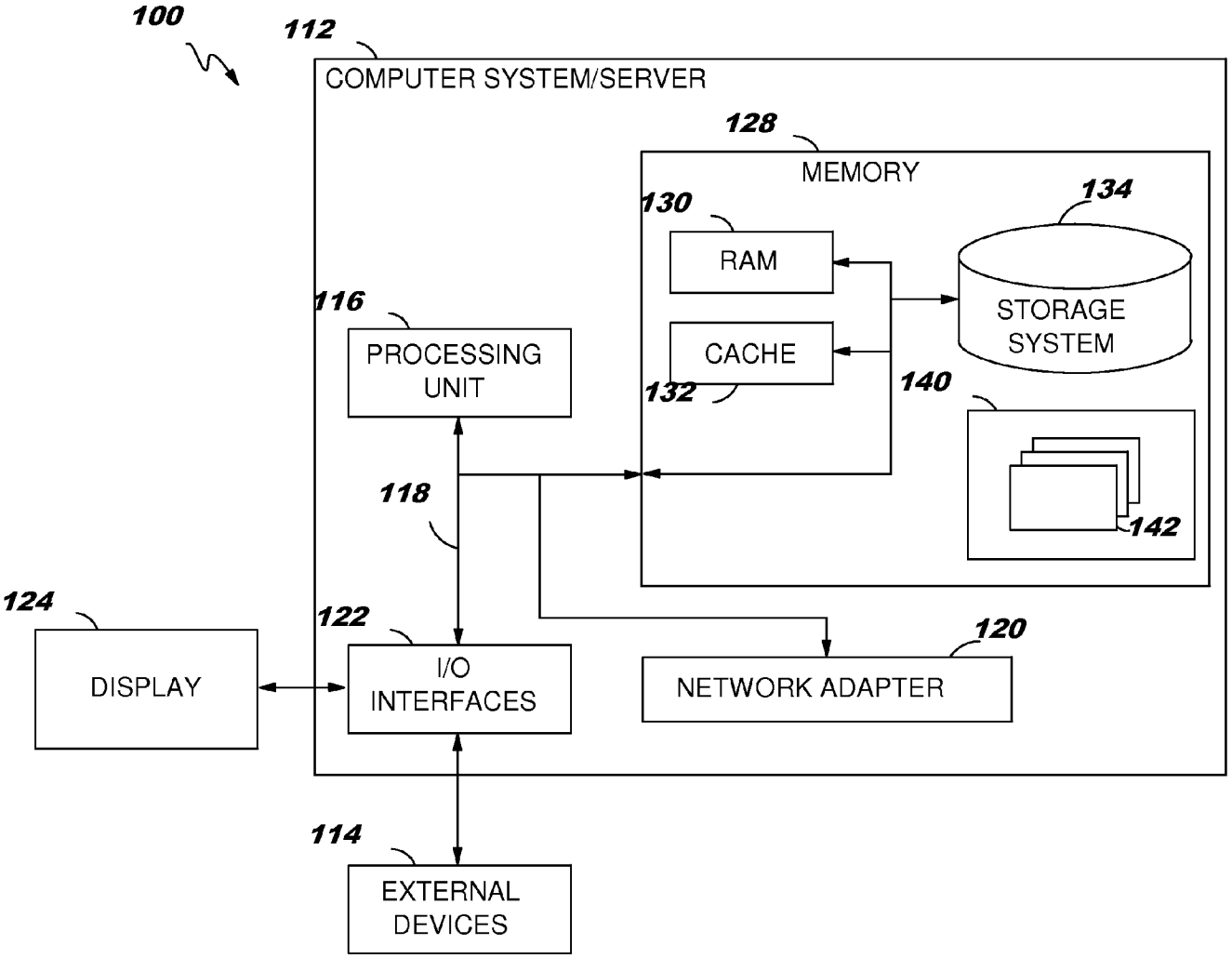
FIG. 1 is a block diagram of an illustrative data processing system in which various embodiments of the present disclosure may be implemented.

FIG. 1 is a block diagram of an illustrative data processing system in which various embodiments of the present disclosure may be implemented. Data processing system 100 is one example of a suitable data processing system and is not intended to suggest any limitation as to the scope of use or functionality of the embodiments described herein. Regardless, data processing system 100 is capable of being implemented and/or performing any of the functionality set forth herein such as controlling a hearing aid based on an adjustable policy.

In data processing system 100 there is a computer system/server 112, which is operational with numerous other general purpose or special purpose computing system environments, peripherals, or configurations. Examples of well-known computing systems, environments, and/or configurations that may be suitable for use with computer system/server 112 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 112 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 112 may be practiced in distributed computing environments where tasks are performed by remote processing devices that are linked through a communications network. In a distributed computing environment, program modules may be located in both local and remote computer system storage media including memory storage devices.

As shown in FIG. 1, computer system/server 112 in data processing system 100 is shown in the form of a general-purpose computing device. The components of computer system/server 112 may include, but are not limited to, one or more processors or processing units 116, a system memory 128, and a bus 118 that couples various system components including system memory 128 to processor 116.

Bus 118 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 112 typically includes a variety of non-transitory computer system usable media. Such media may be any available media that is accessible by computer system/server 112, and it includes both volatile and non-volatile media, removable and non-removable media.

System memory 128 can include non-transitory computer system usable media in the form of volatile memory, such as random access memory (RAM) 130 and/or cache memory 132. Computer system/server 112 may further include other non-transitory removable/non-removable, volatile/non-volatile computer system storage media. By way of example, storage system 134 can be provided for reading from and writing to a non-removable, non-volatile magnetic media (not shown and typically called a "hard drive"). Although not shown, a USB interface for reading from and writing to a removable, non-volatile magnetic chip (e.g., a "flash drive"), and an optical disk drive for reading from or writing to a removable, non-volatile optical disk such as a CD-ROM, DVD-ROM or other optical media can be provided. In such instances, each can be connected to bus 118 by one or more data media interfaces. Memory 128 may include at least one program product having a set (e.g., at least one) of program modules that are configured to carry out the functions of the embodiments. Memory 128 may also include data that will be processed by a program product.

Program/utility 140, having a set (at least one) of program modules 142, may be stored in memory 128 by way of example, and not limitation, as well as an operating system, one or more application programs, other program modules, and program data. Each of the operating system, one or more application programs, other program modules, and program data or some combination thereof, may include an implementation of a networking environment. Program modules 142 generally carry out the functions and/or methodologies of the embodiments. For example, a program module may be software for controlling a hearing aid based on an adjustable policy.

Computer system/server 112 may also communicate with one or more external devices 114 such as a keyboard, a pointing device, a display 124, etc.; one or more devices that enable a user to interact with computer system/server 112; and/or any devices (e.g., network card, modem, etc.) that enable computer system/server 112 to communicate with one or more other computing devices. Such communication can occur via I/O interfaces 122 through wired connections or wireless connections. Still yet, computer system/server 112 can communicate with one or more networks such as a local area network (LAN), a general wide area network (WAN), and/or a public network (e.g., the Internet) via network adapter 120. As depicted, network adapter 120 communicates with the other components of computer system/server 112 via bus 118. It should be understood that although not shown, other hardware and/or software components could be used in conjunction with computer system/server 112. Examples, include, but are not limited to: microcode, device drivers, tape drives, RAID systems, redundant processing units, data archival storage systems, external disk drive arrays, etc.

Figure 2:
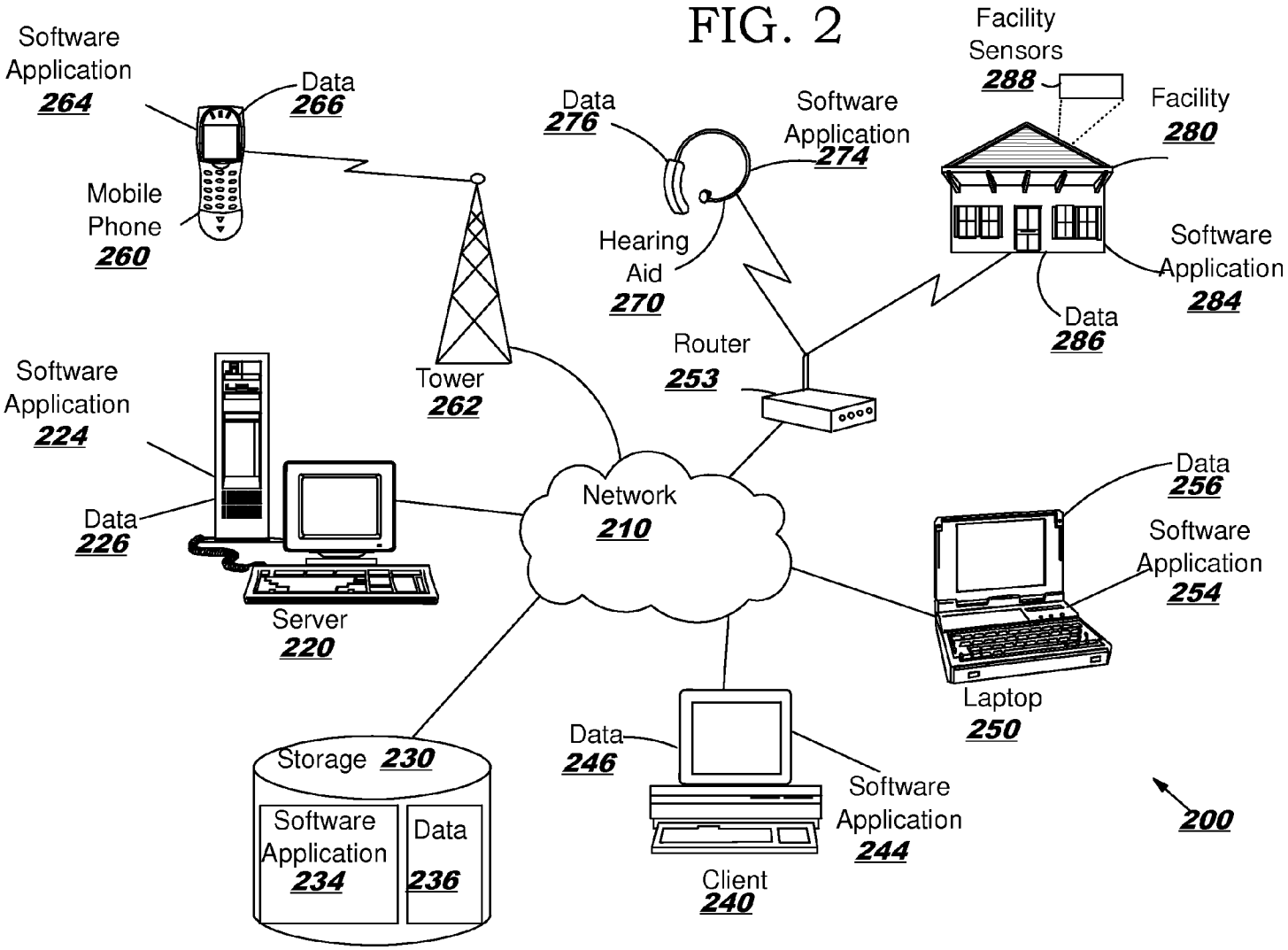
FIG. 2 is a block diagram of an illustrative network of data processing systems in which various embodiments of the present disclosure may be implemented.

FIG. 2 is a block diagram of an illustrative network of data processing systems in which various embodiments of the present disclosure may be implemented. Data processing environment 200 is a network of data processing systems such as described above with reference to FIG. 1. Software applications such as for controlling a hearing aid based on an adjustable policy may execute on any computer or other type of data processing system in data processing environment 200. Data processing environment 200 includes network 210. Network 210 is the medium used to provide simplex, half duplex and/or full duplex communications links between various devices and computers connected together within data processing environment 200. Network 210 may include connections such as wire, wireless communication links, or fiber optic cables.

Server 220 and client 240 are coupled to network 210 along with storage unit 230. In addition, laptop 250, hearing aid 270 and facility 280 (such as a home or business) including facility sensors 288 are coupled to network 210 including wirelessly such as through a network router 253 or other facility communication device. For example, the connection may be by infrared, magnetic, electronic, or other type of wireless communications. A mobile phone 260 may be coupled to network 210 through a mobile phone tower 262. Data processing systems, such as server 220, client 240, laptop 250, mobile phone 260, hearing aid 270 and facility 280 contain data and have software applications including software tools executing thereon. Other types of data processing systems such as personal digital assistants (PDAs), smartphones, tablets and netbooks may be coupled to network 210.

Server 220 may include software application 224 and data 226 for controlling a hearing aid based on an adjustable policy or other software applications and data in accordance with embodiments described herein. Storage 230 may contain software application 234 and a content source such as data 236 for controlling a hearing aid based on an adjustable policy. Other software and content may be stored on storage 230 for sharing among various computer or other data processing devices. Client 240 may include software application 244 and data 246. Laptop 250 and mobile phone 260 may also include software applications 254 and 264 and data 256 and 266. Hearing aid 270 and facility 280 may include software applications 274 and 284 as well as data 276 and 286. Other types of data processing systems coupled to network 210 may also include software applications. Software applications could include a web browser, email, or other software application for controlling a hearing aid based on an adjustable policy.

Server 220, storage unit 230, client 240, laptop 250, mobile phone 260, hearing aid 270 and facility 280 and other data processing devices may couple to network 210 using wired connections, wireless communication protocols, or other suitable data connectivity. Client 240 may be, for example, a personal computer or a network computer.

In the depicted example, server 220 may provide data, such as boot files, operating system images, and applications to client 240 and laptop 250. Server 220 may be a single computer system or a set of multiple computer systems working together to provide services in a client server environment. Client 240 and laptop 250 may be clients to server 220 in this example. Client 240, laptop 250, mobile phone 260, hearing aid 270 and facility 280 or some combination thereof, may include their own data, boot files, operating system images, and applications. Data processing environment 200 may include additional servers, clients, and other devices that are not shown.

In the depicted example, data processing environment 200 may be the Internet. Network 210 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 200 also may be implemented as a number of different types of networks, such as for example, an intranet, a local area network (LAN), or a wide area network (WAN). FIG. 2 is intended as an example, and not as an architectural limitation for the different illustrative embodiments.

Among other uses, data processing environment 200 may be used for implementing a client server environment in which the embodiments may be implemented. A client server environment enables software applications and data to be distributed across a network such that an application functions by using the interactivity between a client data processing system and a server data processing system. Data processing environment 200 may also employ a service oriented architecture where interoperable software components distributed across a network may be packaged together as coherent business applications.

Figure 3:
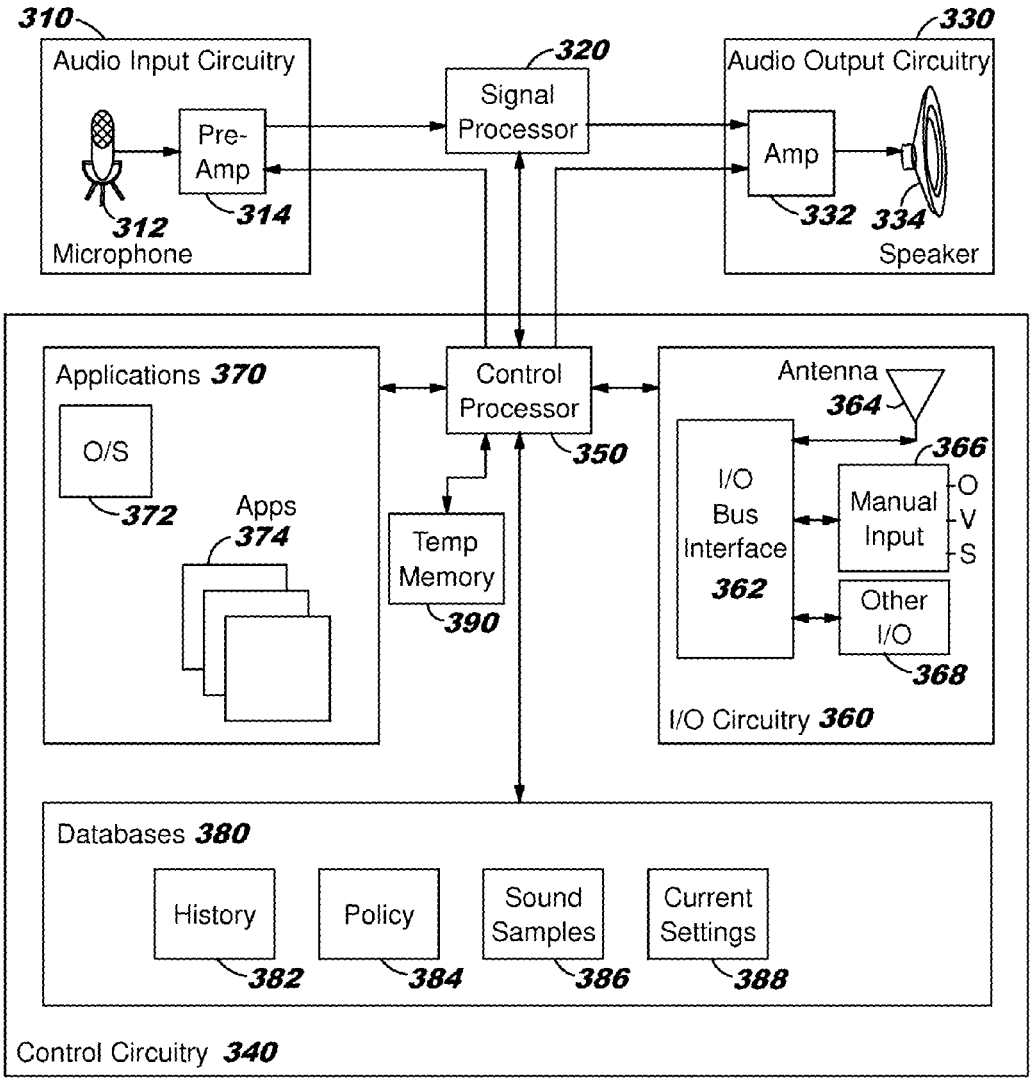
FIG. 3 is a block diagram of a smart hearing aid in which various embodiments may be implemented.

FIG. 3 is a block diagram of a smart hearing aid in which various embodiments may be implemented. The hearing aid includes audio input circuitry 310, signal processor 320, audio output circuitry 330 and control circuitry 340.

Audio input circuitry 310 receives ambient audio for possible amplification. Audio input circuitry 310 includes a microphone 312 for receiving audio input from the surrounding area and for providing an initial audio input signal that is provided to a preamplifier 314 for performing initial amplification of the audio input signal. Such preamplification can improve the ability of the signal processor to analyze the audio input signal. Audio input circuitry 310 also receives some control signals from control circuitry 340 such as to shut down or reduce signal detection and preamplification to reduce power consumption.

Signal processor 320 analyzes the audio input signal from audio input circuitry 310, provides information regarding that signal to control circuitry 340, and then generates an output signal to audio output circuitry 330 based on inputs from control circuitry 340. For example, the audio input signal may be passed directly on to audio output circuitry 330, may be modified such as by masking or reducing certain frequencies, or it may be supplemented with certain other signals as instructed by control circuitry 340. Signal processor may include a digital signal processor (DSP). Additional circuitry may also be included such as a digital to analog converter to convert the pre-amplified audio input into a digital input for the DSP and an analog to digital converter to convert the signal processor output from the DSP to an analog output signal.

Audio output circuitry 330 receives the signal from signal processor 320 and amplifies that signal for playing as instructed by control circuitry 340. Audio output circuitry 330 includes an amplifier 332 for amplifying the signal processor signal and a speaker 334 for playing the amplified signal. Audio output circuitry also receives signals from control circuitry 340 such as to shut down to reduce power consumption or reduce signal amplification to a level appropriate for the wearer of the hearing aid. The audio output is intended to be heard by the person wearing the hearing aid. Alternative embodiments of the audio input and output circuitry could include additional circuitry for performing certain tasks such as filtering the signal. Additional circuitry may also be included such as digital to analog converters and analog to digital converters.

Control circuitry 340 includes a control processor 350, input/output circuitry 360, applications 370, databases 380 and temporary memory 390. Control processor 350 runs applications stored in applications 370 for managing the hearing aid functions including controlling signal processor 320 pre-amplifier 314 and amplifier 332. Control processor also communicates with external devices through input/output circuitry 360 and obtains needed stored information from database 380. Control processor 350 may be microprocessor, a digital signal processor, or a combination of both. Control processor may also be combined with signal processor 320 as a single unit.

Input output (I/O) circuitry 360 includes an I/O bus interface 362, an antenna 364, manual input 366 and other I/O 368. I/O bus interface 362 allows the control processor to communicate with a variety of external sources through several types of communication standard. For example, an external device such as a home automation or security system, a computer or other data processing system wireless device may communicate with the control processor through antenna 364 and I/O bus interface 362. The user can also input certain information through manual devices such as an on/off switch (O), a manual volume control (V), and a sample button (S) through manual input 366 and I/O bus interface 362. Other types of communication with external devices are also available such as with electronic, infrared, magnetic, inductive or vibration signals through other I/O 368 and I/O bus interface 362.

I/O circuitry can allow a wide variety of applications through interactions with external devices. For example, a wearer could receive a wireless signal from a television with the audio signal of a broadcast. The wearer could then hear the audio signal without the external volume of the television being loud or even audible. This can relieve other family members of the discomfort of listening to a loud television. Motion sensors for a home security or home automation system could provide a wireless signal to the hearing aid to turn up the hearing aid volume or generate an audible signal on the hearing aid indicating when a person enters the room. Other devices can also send signals or alerts when certain events occur. This can be wireless signals that can signal the hearing aid to provide an audible signal. Alternatively, the hearing aid can be trained to turn up its volume when it detects certain sounds such as a microwave or smoke alarm beep.

Applications 370 include an operating system (O/S 372 and various software or firmware applications 374 which can be utilized to manage the operations of control processor 350. These applications can be discrete independent programs or integrated centrally controlled programs.

Databases 380 include a variety of information stored in memory for use by applications running on processor 350. This information may also be downloaded to external data processing systems for additional analysis and input. Databases 380 include history 382, policy 384, sound sample 386 and current settings 388. History 382 includes historical information regarding the operation of the hearing aid which may be useful for analysis by a physician or other health care professional. Policies 384 include policies utilized to manage the operation of the hearing aid upon the occurrence of certain detected characteristics. For example, if a snoring sound is detected, the wearer or user of the hearing aid may be asleep and the hearing aid may be reduced in volume or turned off. Sounds samples 386 includes sound samples including their characteristics that can be compared to detected sounds. The sound samples can be stored uncompressed, compressed, or derivatives of the sound samples can be stored, all which can be compared with other sound samples. Any of these types of sound samples can be considered as characteristics of the underlying actual sound. In the snoring example provided, the sound of snoring may be detected by comparing the sound detected to a snoring sound stored in sound samples 386.

Temporary memory 390 is utilized for the continuous storage of recent sound (or silence) obtained by signal processor 320. This allows the control processor to look back a few seconds or more to obtain sound samples for comparison purposes as described below.

Alternative embodiments may utilize alternative hearing aid configurations. For example, control circuitry 340 may contain additional processors for performing background tasks when needed. Sound Signal processor 320 may be combined with control processor 350. Databases 380 may be combined in alternative configurations, such as combining history 382 with sound samples 386. Additional or different information may be collected and stored for use in each database.

Figure 4:
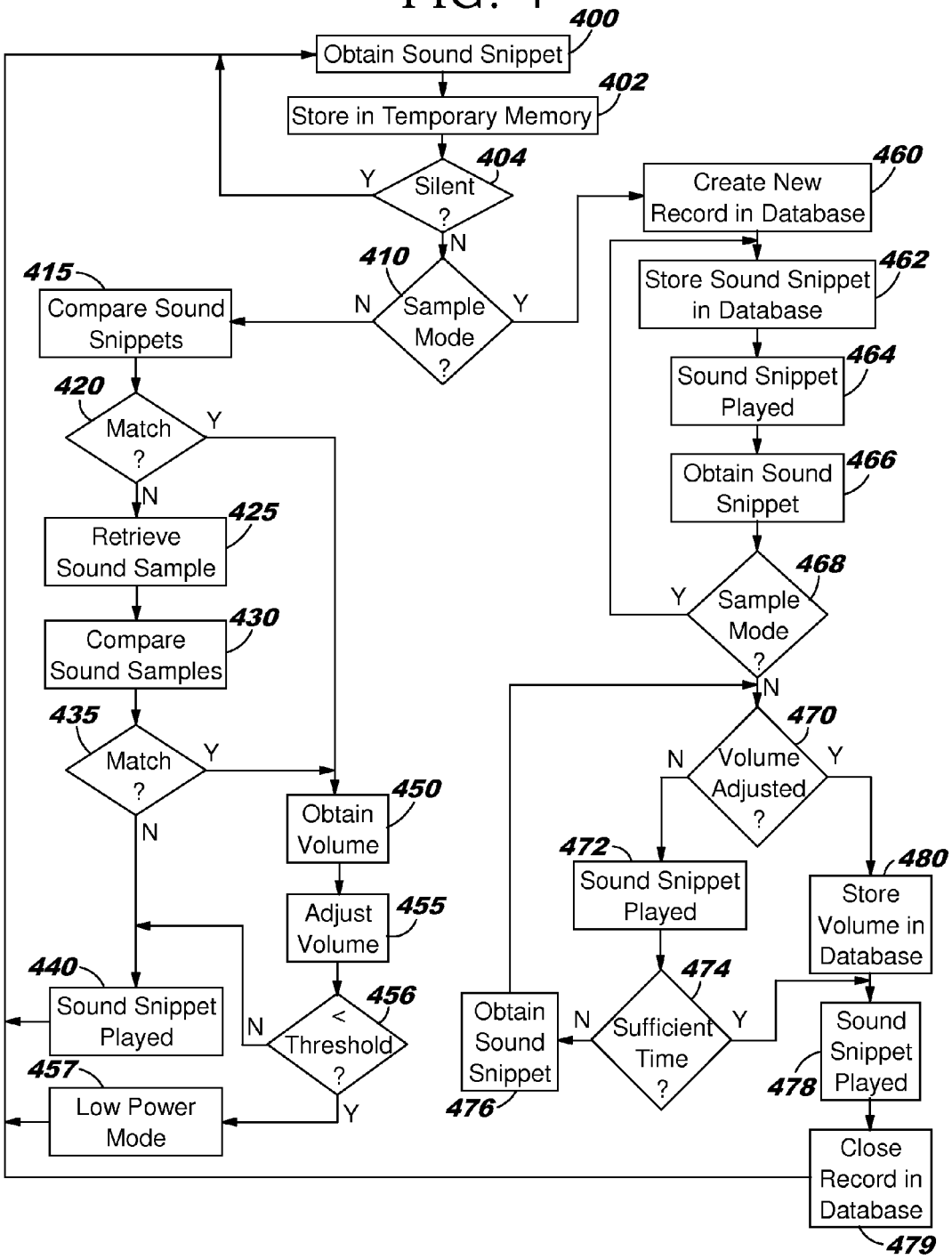
FIG. 4 is a flow diagram of the control circuitry managing the operation of the hearing aid in accordance with a first embodiment.

FIG. 4 is a flow diagram of the control circuitry managing the operation of the hearing aid in a learning mode in accordance with a first embodiment. In a first step 400, a current sound snippet for the current time period (e.g. 50 milliseconds) is obtained by the signal processor. Then in step 402, the current sound snippet will be stored in temporary memory adjoining previous sound snippets from previous time periods. Any sound snippet over a certain age (e.g. 10 seconds) will be erased from temporary memory. As a result, temporary memory contains a recording of the most recent sounds. Even silent sound snippets are stored as periods of silence within a longer sound sample can be important in identifying distinctive sounds. Then in step 404, it is determined whether the sound snippet is silent. If yes, then processing returns to step 400, otherwise processing continues to step 410. In step 410 it is determined whether the user has selected sample mode. The user can indicate sample mode by pressing a sample button on the hearing aid or by providing a signal to the hearing aid that a sample is requested. This signal could come from an infrared remote control device or other device which provides a signal recognizable by the hearing aid. If not, then processing continues to step 415, otherwise processing continues to step 460.

In step 415, the current sound snippet is compared to other sound snippets stored in the sound sample database. This comparison is a comparison of the characteristics of the sound snippets and may include the original sound snippets obtained by the signal processor or derivatives of those sound snippets. Then in step 420, it is determined whether certain criteria are met such that there is a match. For example, a clap may be a short burst of sound sufficient to be recognized and used to adjust the volume. A match means that there is a similarity in the characteristics between the sound snippets sufficient to reasonably infer that there is a match. There may be an analytical similarity test performed with the results of the similarity exceeding a sound matching threshold criterion indicating that there is a match or not. If there is a match (i.e., the criteria for a match are met), then processing continues to step 450, otherwise processing continues to step 425. In step 425, a current sound sample, including the current sound snippet concatenated with the other most recent sound snippets, is retrieved from temporary memory. The length of the sound sample can be the full length of temporary memory or a shorter time period depending on preferences. Although a processing a single current sound sample of a given length is described here, sounds samples of differing lengths could be retrieved and used as described herein. The current sound sample is compared to the other sound samples stored in the sound sample database in step 430. Then in step 435, it is determined whether certain criteria are met such that there is a match. This comparison is a comparison of the characteristics of the sound samples and may include the original sound samples obtained by the signal processor or derivatives of those sound samples. There may be an analytical similarity test performed with the results of the similarity exceeding a sound matching threshold criterion indicating that there is a match or not. If there is a match (i.e., the criteria for a match are met), then processing continues to step 450, otherwise processing continues to step 440. A match means that there is a similarity in the characteristics between the sound samples sufficient to reasonably infer that there is a match.

In step 440, the sound snippet is played through the hearing aid speaker and processing returns to step 400. Generally, the whole sound sample is not played as that could create a temporary or continuing discontinuity between what the user sees and hears. However, if there is a period of silence or quiescence after the sound that was sampled, then the whole sound sample may be played without creating any long term discontinuities.

In step 450, the volume of the matching sound snippet or sample is obtained. The volume is a policy which can be stored in the sound sample database. Alternatively, a policy ID may be stored in the sound sample database and used to look up volume in the policy database. In another alternative, any criteria met to identify the matching sound sample may be utilized to look up the policy. Then in step 455, the volume of the hearing aid is adjusted based on the obtained volume such as by signaling the amplifier to increase or decrease amplification. After adjusting the volume, the adjusted volume is compared to a volume threshold criterion in step 456. If the adjusted volume is not below the threshold, then processing then continues to step 440 for playing the sound snippet. If the adjusted volume is below the threshold such that the sound is not readily discernable by the user, then the hearing aid enters a low power mode in step 457 and processing returns to step 400. In the low power mode, all amplification is turned off to save power, although sampling continues in case there is another sound detected which would raise the volume, thereby automatically exiting the hearing aid from the low power mode. The threshold can be modified by the user or a health care provider.

In an alternative embodiment, if a particular sound or sound snippet is recognized and a policy change is implemented such that the volume is increased, a determination may be made whether the user of the device heard the sound. For example, if the sound is a smoke alarm, then the user should move in response. In such a case, am accelerometer within the hearing aid may be checked for motion. Alternatively, a motion sensor such as from the home security system may be checked using an external signal to determine whether any movement has occurred. If no movement has occurred, then several actions may be taken depending on the policy. For example, the volume may be increased further, a vibration may be generated in the hearing aid, the lights in the room may be flashed through the I/O interface, etc. These actions may be part of the adjustable policy for the particular sound.

In step 460, a sound sampling session has been initiated so a new sample record is created in the sound sample database with a time stamp. The time stamp also acts as a sound sample identifier. In step 462, the current sound snippet is stored in the sample record adjoining any previous sound snippets from the same sampling session. Then in step 464, the sound snippet is played through the hearing aid speaker. In step 466, a new sound snippet is obtained from the signal processor for the next time period. In subsequent step 468, it is determined whether the sample mode is continuing. This can occur by the user releasing the sample button on the hearing aid, by an interruption in the signal from the remote device, a new signal from the remote device requesting an end to the sampling, or other criteria. If not, then processing continues to step 470, otherwise processing returns to step 462.

In step 470, it is determined whether the volume has been manually adjusted. If yes, then processing continues to step 480, otherwise processing continues to step 472. In step 472, the sound snippet is played through the hearing aid speaker.

The in step 474, it is determined whether a sufficient time has passed for waiting for a volume adjustment (e.g., a criterion of 3 seconds). If not, then a new sound snippet is obtained during the next time period in step 476 and processing returns to step 470. If a sufficient time period has passed, then in step 478 the sound snippet is played through the hearing aid speaker. Then in step 479, the sample record in the sound sample database is closed and processing returns to step 400. If no volume adjustment was indicated in the sample record, then that record may not be compared to with any new sound samples. A bypass flag may be set in a special field to indicate that this sound sample should be bypassed when comparing sound samples.

In step 480, the sound sample was completed and the volume adjusted within a short time period. This indicates that the user wants the volume adjusted to the desired level whenever this sampled sound or similar sound is detected. This can include increasing the volume or decreasing the volume. In this step, the volume level indicated is stored for future reference. The volume level is considered a policy and can be stored in the database with the sound sample. Alternatively, a policy ID may be identified from the policy database with the desired volume level and then the policy ID is stored in the database with the sound sample. In another alternative, any criteria met to identify the matching sound sample may be utilized to look up the policy. Processing then returns to step 478.

FIGS. 5A through 5E are flow diagrams of the control circuitry managing the operation of the hearing aid in accordance with a second embodiment. In this embodiment, there are multiple concurrently running processes that manage volume settings and frequency settings with inputs from more sources than the first embodiment.

Figure 5A:
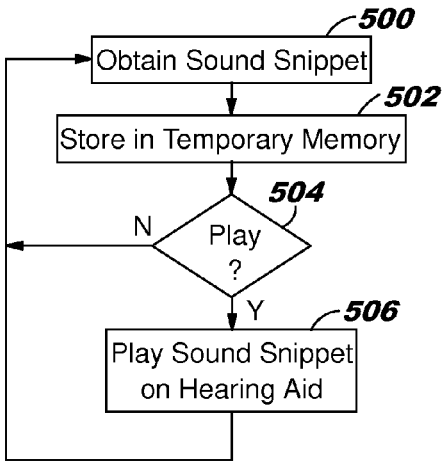
FIGS. 5A through 5E are flow diagrams of the control circuitry managing the operation of the hearing aid in accordance with a second embodiment.

FIG. 5A is a flow diagram of a sound detection, storage and playing application. This application continually of receives ambient sounds, stores those sounds to a temporary memory for use by other applications, and then plays those sounds according to current volume and frequency settings. In a first step 500, a current sound snippet for the current time period (e.g. 50 milliseconds) is obtained by the signal processor. Then in step 502, the current sound snippet will be stored in temporary memory adjoining previous sound snippets from previous time periods. This can be the original sound snippet as detected by the signal processor, a compressed version of that sound snippet, or a derivative of that snippet useful for determining is there are any other matching sounds. The information stored is referred to herein as the characteristics of the sound. Any sound snippet over a certain age (e.g. 30 seconds) will be erased from temporary memory as part of this process. As a result, temporary memory contains a recording of the most recent sounds. Even silent sound snippets are stored as periods of silence within a longer sound sample can be important in identifying distinctive sounds. Then in step 504, it is determined whether sound input is being played audibly at this time by checking current volume, frequency and I/O settings in the database to determine whether they meet certain criteria. If yes (i.e., the criteria for a match are met), then in step 506 the sound snippet is played through the hearing aid speaker at a current sound volume level and with current sound frequency adjustments. If there are frequency adjustments, the signal processor can modify the sound snippet based on current frequency settings which are determined as described below. After step 506, or if not in step 504, processing then returns to step 500. This process maintains a constant flow of sound snippets through temporary memory for processing as described below while also playing those snippets for the wearer in accordance with current volume and frequency settings on a real time basis.

Figure 5B:
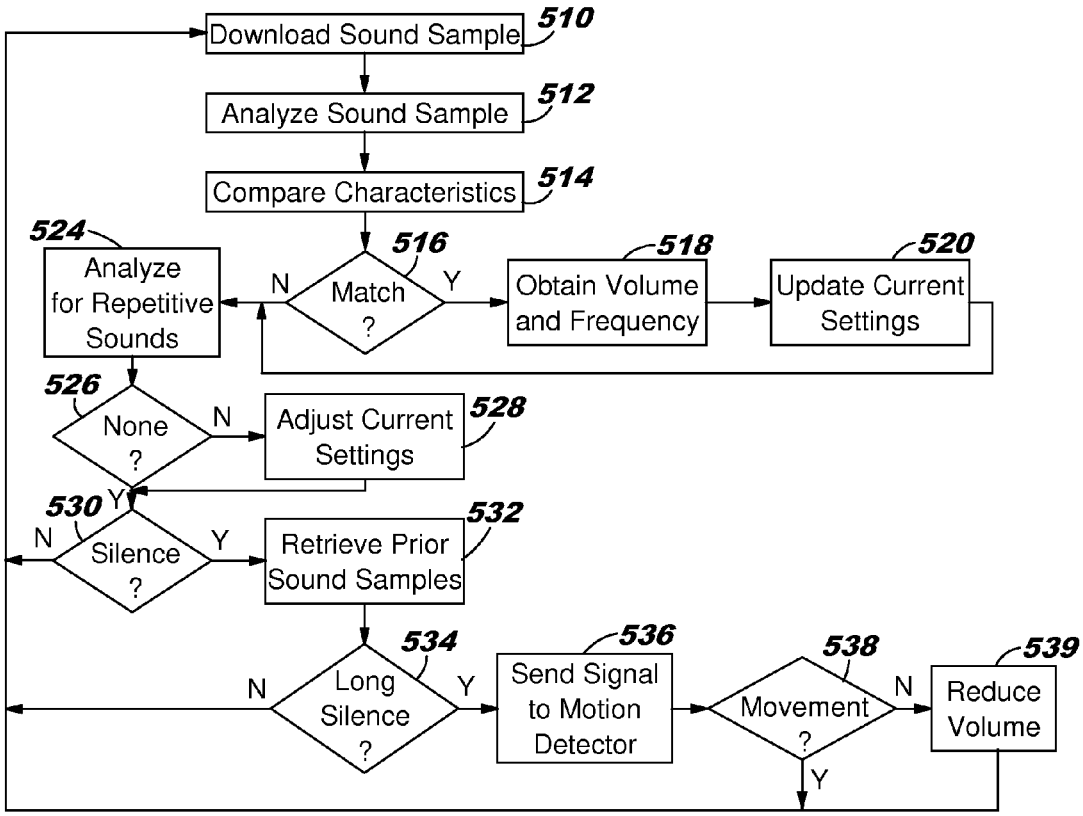

FIG. 5B is a flow diagram of a sound monitoring application that runs concurrently with the sound detection, storage and playing application. This application monitors current sounds stored in temporary memory for a variety of purposes as described below. Additional monitoring subroutine or applications may be utilized to monitor the sounds detected and stored in temporary memory. This application may perform sound identification and/or or voice recognition depending on the implementation.

In a first step 510, the most recent sound sample is downloaded from temporary memory and on a periodic basis (e.g., every 5 seconds). The sound sample can be a standard length such as 15 seconds. That sound sample is then analyzed and processed in step 512 to determine its characteristics. This can include a description of the frequencies involved, any repetitiveness of the sounds, etc. Fourier analysis is one example of this type of analysis. Then in step 514, those characteristics are compared to the characteristics of other sound samples stored in the sound sample database. In step 516, it is determined whether certain criteria are met such that there is a substantial similarity of a match. There may be an analytical similarity test performed with the results of the similarity exceeding a sound matching threshold criterion indicating that there is a match or not. A match means that there is a similarity in the characteristics between the sound samples sufficient to reasonably infer that there is a match (i.e., the criteria for a match are met). Such an inference may be determined using statistical analysis. For example, if a person says "John" to the wearer, then that sound may be detected, matched to a set of samples of that name, and used to automatically increase the volume setting. If there is not a match, then processing continues to step 524, otherwise processing continues to step 518. In step 518, the volume and frequency settings for the matched sound sample in the database are obtained using the policy ID stored with the sound sample (or the criteria used to identify the sound sample). Then in step 520, the current settings are updated with the new volume and frequency settings. Processing then proceeds to step 524. In an alternative embodiment, sound similarity may be distinguished from voice recognition. For example, if a person says "John", then that sound could be recognized later if spoken by the same person. However, if a different person says "John", then that sound may be different due to vocal differences between people. Voice recognition technology is often able to provide criteria for identifying a common word spoken by different people. For certain sounds/word, voice recognition technology may be utilized to look for certain words regardless of who speaks those words.

In step 524, the sound sample characteristics are analyzed to determine whether certain criteria are met such that a repetitive sound may have occurred. That is, the sound sample characteristics are analyzed for identifying strong repeating sounds such as might be caused by a fan or other repetitive equipment. This may be strongly shown in Fourier analysis of the sound sample. If it is determined in step 526 that there are no repetitive sounds, then processing continues to step 530. Otherwise, in step 528 the current volume and frequency settings may be adjusted to reduce the volume of the repetitive sound and processing continues to step 530. In an alternative embodiment, if there are no other sounds besides the repetitive sound and if the volume is reduced below a certain threshold, then the hearing aid enters a low power mode. In the low power mode, all amplification is turned off to save power, although sampling continues in case there is another sound detected which would raise the volume, thereby automatically exiting the hearing aid from the low power mode. The threshold can be modified by the user or a health care provider.

In step 530, it is determined whether there has been a period of silence. If yes, then additional prior sound samples stored in temporary memory may be retrieved in step 532, otherwise processing returns to step 510. If those retrieved earlier samples also show a long period of silence in step 534 meeting a threshold criterion, then in step 536 a signal can be sent to a home security system to determine whether there is movement in the room, otherwise processing continues to step 534. Then in step 538, if a positive signal is received from the home security system indicating movement, then certain criteria have not been met and processing returns to step 510. Otherwise the volume setting stored in current settings may be reduced in step 539 and then processing then returns to step 510. In an alternative embodiment, if the volume is reduced below a certain threshold such that the sound is not readily discernable by the user, then the hearing aid enters a low power mode. In the low power mode, all amplification is turned off to save power, although sampling continues in case there is another sound detected which would raise the volume, thereby automatically exiting the hearing aid from the low power mode. The threshold can be modified by the user or a health care provider.

Figure 5C:
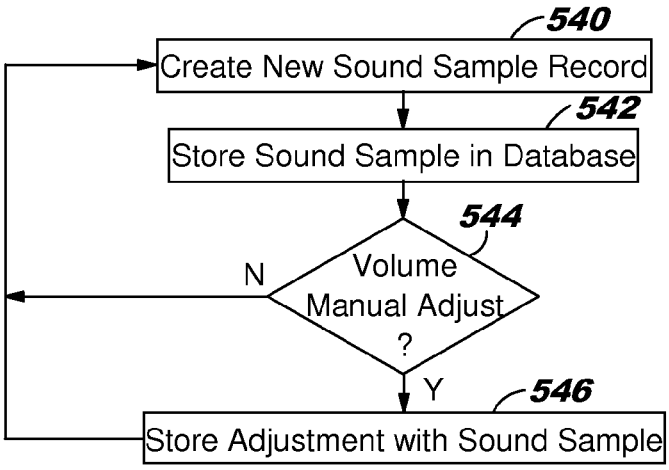

FIG. 5C is a flow diagram of a sound teaching application that runs concurrently with the sound detection, storage and playing application. This application is utilized by the user to create sound samples such as utilized by the sound monitoring application. This application may also be utilized to modify, set, and change the adjustable policy. This application can be initiated by the user pressing a sample button on the hearing aid or by providing a signal to the hearing aid that a sample is requested. This signal could come from an infrared remote control device or other device which provides a signal recognizable by the hearing aid.

In step 540, a sound sampling session has been initiated so a new sample record is created in the sound sample database with a time stamp. In step 542, so long as the sample button is pressed, there is no interruption in the sample signal from the infrared device, or no new signal is received indicating an end to the sample, the sounds obtained by the signal processor are stored in the sound sample database. Once the sample is completed in step 542, then in step 544 it is determined whether the volume has been manually adjusted within a certain time period (e.g., a criterion of 5 seconds). If yes, then in step 566 the volume indicated by the adjustment may be stored with the sample. The volume is a policy which can be stored in the sound sample database. The volume is a policy which can be stored in the sound sample database. Alternatively, a policy ID may be identified for storage in the sound sample database and can be used to look up volume (and other characteristics) in the policy database. Alternatively, if no in step 544 or after the completion of step 546, the sound sample record is closed and processing returns to step 540 for handling the next sound sample. If there was no volume adjustment, a special field may be utilized to indicate that the sound sample should be bypassed by the monitoring application.

This allows the user to record a specific sound with a requested volume for that sound for use by the monitoring application if certain criteria are met such as described above. For example, if the user wants the hearing aid volume to be increased when his or her name is called, to a clap by another person, to a beep from a microwave or smoke alarm, etc., the user can utilize this process to program that change. If the user wants to lower volume when certain sounds occur or after a time period of silence, then the user can also utilize this process to program that change. For example, the user can simply record a period of silence and then turn down volume at the end of that recording to adjust the length of time needed to turn down volume after silence. Also, if no increase or decrease in volume is detected when storing a sound sample, then that sound sample can be later analyzed offline as described below.

All these sound samples as well as the hearing aid history can be downloaded from the hearing aid to an external system such as a laptop by the user or a health case processional for further adjustment. For example, it is difficult for a user to adjust frequency settings as the sound is being sampled. However, such adjustments would be made offline, including by a health care processional at a remote location, so that the response to those sounds by the monitoring application can be improved. Also, certain sound samples that did not have volume adjustments could be analyzed using this process for adding volume or frequency setting adjustments at that time. All these adjustments could then be uploaded back to the hearing aid through the I/O interface.

Figure 5D:
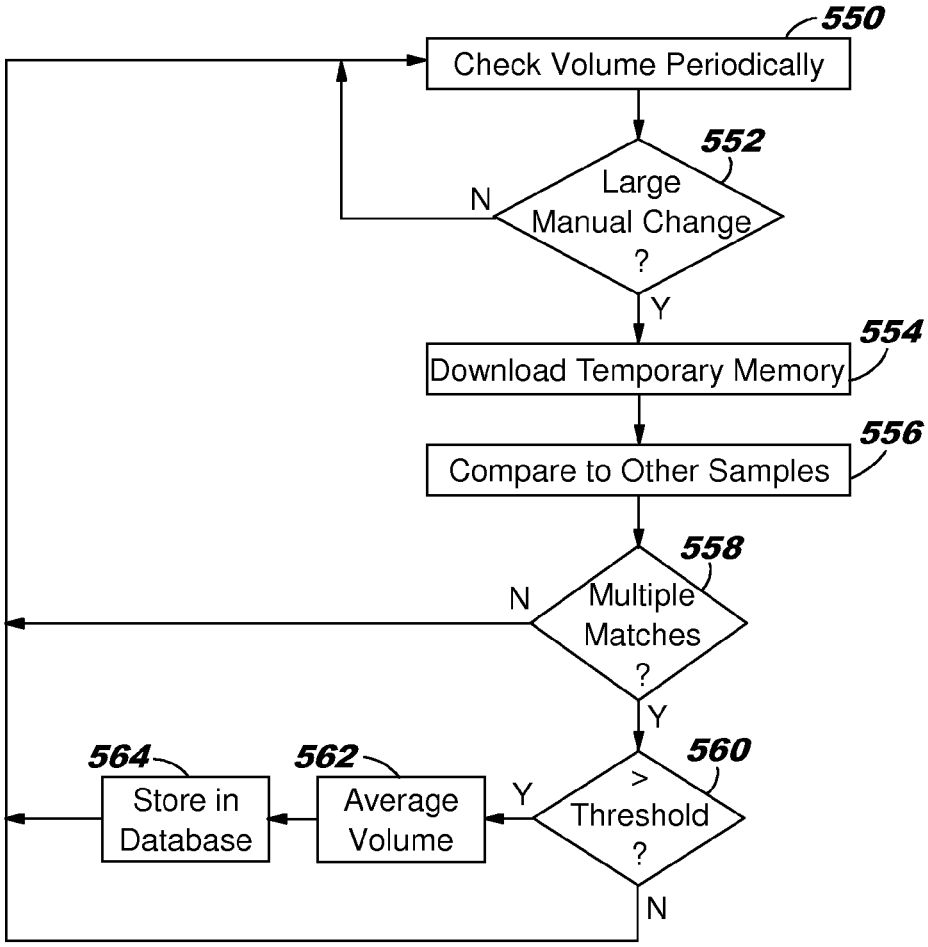

FIG. 5D is a flow diagram of a sound learning application that runs concurrently with the sound detection, storage and playing application. This application stores examples of sound samples when the volume is turned up or down. These sound samples can then be analyzed to determine whether there are certain sounds that should be added to the list of sound samples that could be used for automatically turning up or down the volume. This application can be running whenever the hearing aid is turned on.

In a first step 550, the application checks the volume periodically (e.g. every 5 seconds). Then in step 552, it determines whether there has been a large change in volume by the user (by user manual entry, not by the monitoring process described above). This can be accomplished by querying the control processor. If no manual change, then processing returns to step 550 to repeat until a large change in volume by the user is detected in step 552. Once a large change in volume by the user is detected, then in step 554, the contents of temporary memory are downloaded to the sound samples database with a time stamp and the volume change indicted by the user. To distinguish from sound samples with volume adjustments generated using the teaching application, a special field with a bypass flag may be utilized to indicate that the sound sample should be bypassed by the monitoring application.

Processing then continues to step 556 where the sample is compared to other samples similarly recorded by the learning application (with volume adjustments and bypass indicators in the sound sample database) according to certain criteria. If it is determined in step 558 that there are multiple matches to the current sound sample downloaded from temporary memory, then processing continues to step 560, otherwise processing returns to step 550. A match means that there is a similarity in the characteristics between the sound samples sufficient to reasonably infer that there is a match. There may be an analytical similarity test performed with the results of the similarity exceeding a sound matching threshold criterion indicating that there is a match or not. In step 560, it is determined whether the number of matches exceeds a predetermined threshold for a time period covered (based on the time stamps) indicating a consistent pattern of manual volume adjustments for a specific sound meeting a certain criterion. This can be a threshold that meets certain statistical confidence levels. If no in step 560, then processing returns to step 550, otherwise processing continues to step 562. In 562, the manual volume adjustments for all the matching sound patterns are averaged. Then in step 564, a policy ID with a sound level corresponding to the average manual volume adjustment is determined and stored in the sound sample record and the bypass flag is turned off. As a result, the monitoring application will look for matching sounds in the future for adjusting the volume automatically. Processing then returns to step 550.

Figure 5E:
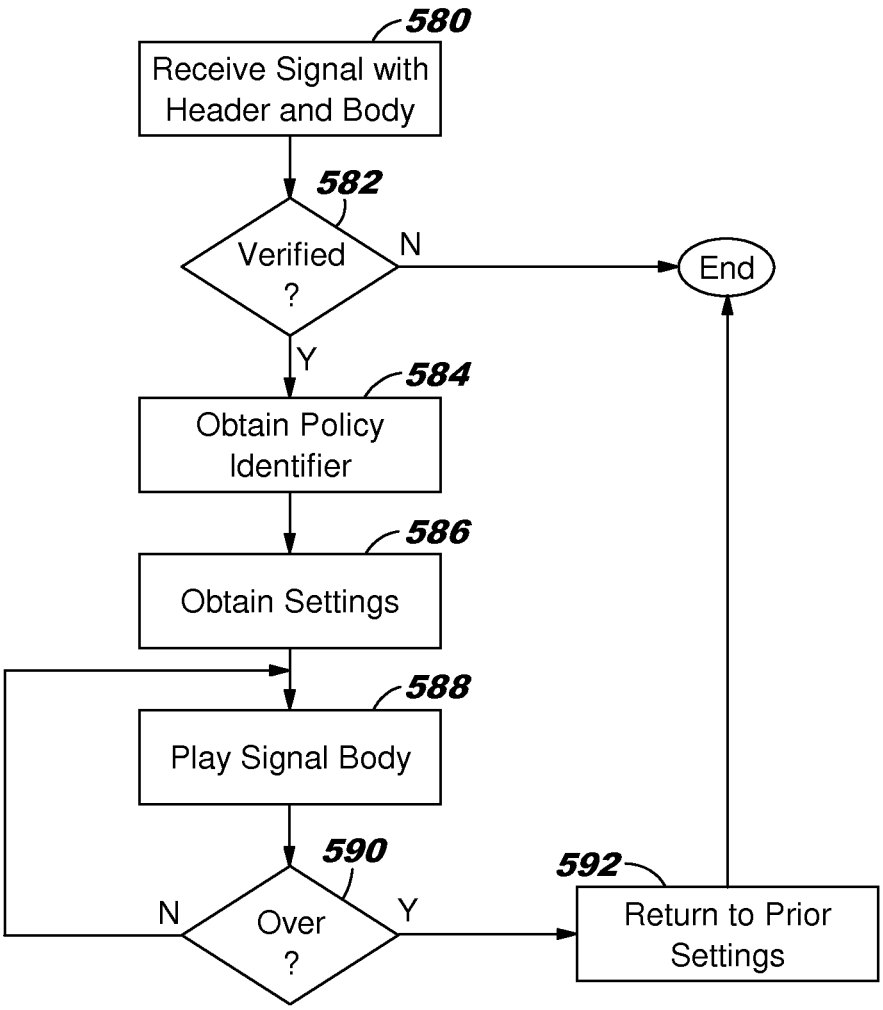

FIG. 5E is a flow diagram of an external device application that runs concurrently with other applications. In this application, external devices can provide sounds for playing on the hearing aid that may or may not be audible to other persons in the same area. For example, a microwave of smoke alarm may provide a beep or a television can provide a sound signal directly to the hearing aid. In a first step 580, a signal with a header and a body is received through an I/O interface. The signal may be an electronic signal, an infrared signal, a magnetic signal, an inductive signal, vibrations or other type of signal. Then in step 582, the signal is verified as a valid signal for the hearing aid by checking the header for verification information according to certain criteria. This can include a password, an encryption key, or other type of verification information. If valid, then processing continues to step 584, otherwise processing ceases. In step 584, a policy identifier is obtained from the header. Then in step 586, the policy ID is used to obtain setting information from the policy database. This can include volume and frequency information as well as whether the signal should be played exclusively. That is, some external signals may be played while all other sounds are muted, or the signal may be played concurrently with other sounds. In step 586, the settings are modified as requested by the external signal.

Then in step 588, the body of the signal is played under the new settings. The body may be a short with a few sounds to be played or it may be a continuous stream of data such as with a television being played. Then in step 590, it is determined whether the external signal is over. This may occur if the body of the signal has been fully played (or interrupted if the external device has been turned off) or if user signifies that the external signal should not be played further. For example, the user may simply turn the hearing aid off, then on again quickly to end the play of the external signal. If the signal is not over, then processing returns to step 588, otherwise processing continues to step 592. In step 592, the hearing aid is returned to the settings prior to the external signal and processing ceases for this application.

Figure 6A:
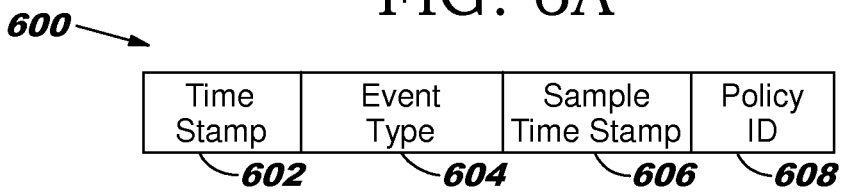
FIGS. 6A through 6D are block diagrams of types of database records in accordance with a second embodiment.
Figure 6B:
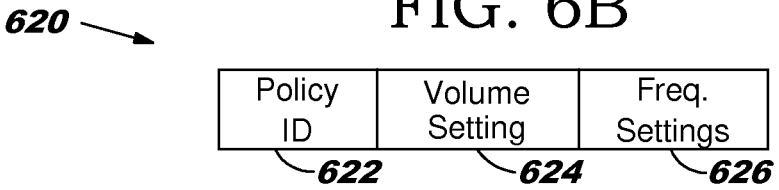
Figure 6C:
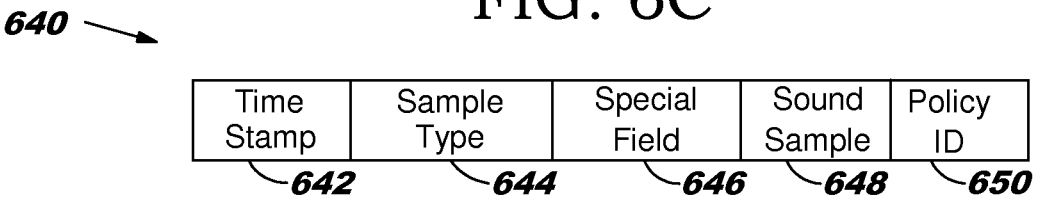
Figure 6D:
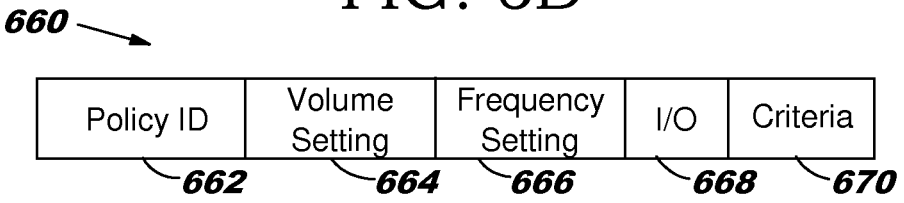

FIGS. 6A through 6D are block diagrams of types of database records in which various embodiments may be implemented. A record is a set of information within a domain or database that establishes a relationship between a set of data or data elements. A record may be a separate entry into a database, a set of links between data, or other logical relationship between a set of data. FIG. 6A is a block diagram of a record 600 stored in a history database. FIG. 6B is a block diagram of a record 620 stored in a policies database. FIG. 6C is a block diagram of a record 640 stored in a sound samples database which can be cross referenced with the policies database. FIG. 6D is a block diagram of a record 660 stored in a current setting database.

FIG. 6A is a block diagram of a record 600 stored in a history database. Record 600 can include a timestamp 602 as a unique identifier, an event type 604, a timestamp of any corresponding sound sample 606, and a policy ID used at the time of the event 608. Every change in the implemented policy of the hearing aid can be stored as a record in the history database. This allows for statistical analysis of the hearing aid and can provide information useful to a healthcare professional analyzing the usage of the hearing aid. For example, the monitored inputs and adjustments can be stored in the history database for performing statistical analysis which can then be used for updating the adjustable policy based on the statistical analysis. This can also be used with information provided by the wearer of the hearing aid to modify the policies, change the policies for certain sound sample, or for other adjustments. For example, the frequency settings may be adjusted for certain sound samples (by selecting a different policy ID) to better address certain issues. The wearer may desire to keep volume up upon the occurrence of certain sounds, yet reduce the volume level for certain frequencies. Event type 604 can include whether the event is a manual adjustment of the hearing aid volume, the detection of a sound sample that affects volume or frequency settings, whether the hearing aid was turned on or off, etc. If a sound sample is involved with modifying the volume level, then the time stamp of the sound sample 606 is included. This can be utilized to determine which sound samples are utilized frequently or not. Policy ID 608 identifies the policy implemented at the time the event occurred.

FIG. 6B is a block diagram of a record 620 stored in a policies database. Record 620 includes a policy identifier (ID) 622, a volume setting 624, and frequency settings 626. Policy ID 622 is used throughout the hearing aid control circuitry to look up various volume and frequency settings for implementation. Volume setting 624 is utilized to control the amplification of the output signal. Frequency settings 626 can include a variety of frequency settings to act as an equalizer or to control the filtering of certain frequencies. For example, certain repetitive sounds may be low frequency. Rather than just turning down the volume, the lower frequencies may be filtered allowing the hearing aid wearer to hear higher frequency conversations.

FIG. 6C is a block diagram of a record 640 stored in a sound samples database which can be cross referenced with the policies database. Record 640 includes a timestamp 642 which also acts as a unique identifier, a sample type 644, a special field 646, a sound sample 648 and a policy ID 650. Timestamp 642 corresponds to when the sound sample was generated. Sample type 644 includes whether the sample is a sound snippet, a longer sound sample, whether the sound sample was obtained by the teaching application or the learning application, etc. Special field 646 can include a variety of other indicators such as a bypass flag indicating that the sound sample should not be used by the monitoring application. Sound sample 648 includes the actual sound sample, a compressed version or a derivative including their characteristics that can be compared to detected sounds. Any of these types of sound samples can be considered as characteristics of the underlying actual sound. Policy ID 650 provides an identifier of the policy to be utilized to control the hearing aid settings in case the sound sample if matched by the monitoring application.

FIG. 6D is a block diagram of a record 660 stored in a current settings database. Record 660 includes a policy ID 662, a volume setting 664, frequency settings 666, I/O flag 668 and criteria 670. The policy indicates the policy in place at the current time. If a new policy is to be implemented, the new policy ID may be compared to the current policy ID to see if not change is actually occurring. The volume setting is the general volume level to control the amplification of the output signal. Frequency settings 666 include any frequency specific modifications to equalize the output signal or to control the filtering of the output signal. I/O flag 668 is utilized to determine whether the signal being played through the hearing aid speaker is from ambient sound detected by the signal processor, from an external source such as a television directly from that television, or a combination of the two.

Criteria 670 are the criteria met to implement this policy. For example, a certain sound sample stored in the sound sample database may be matched with a certain similarity. The use of these criteria allows for a great deal of flexibility in adjusting the criteria for certain events as well as adjusting the volume, frequency or other settings of the hearing aid with the criteria are met. The criteria can be set for sound detection, voice identification, electronic signals, infrared signals, magnetic signals, inductive signals and vibrations. Alternative embodiments may utilize many additional or different settings to tailor the hearing aid to the specific needs of the user.

The invention can take the form of an entirely software embodiment, or an embodiment containing both hardware and software elements. In a preferred embodiment, the embodiments are implemented in software or program code, which includes but is not limited to firmware, resident software, and microcode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer usable medium(s) having computer usable program code embodied thereon.

Any combination of one or more computer usable medium (s) may be utilized. The computer usable medium may be a computer usable signal medium or a non-transitory computer usable storage medium. A computer usable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer usable storage medium would include the following: an electrical connection having one or more wires, a portable computer diskette, a hard disk, a random access memory (RAM), a read-only memory (ROM), an erasable programmable read-only memory (EPROM), or Flash memory, an optical fiber, a portable compact disc read-only memory (CD-ROM), an optical storage device, a magnetic storage device, or any suitable combination of the foregoing. In the context of this document, a computer usable storage medium may be any tangible medium that can contain, or store a program for use by or in connection with an instruction execution system, apparatus, or device.

A computer usable signal medium may include a propagated data signal with computer usable program code embodied therein, for example, in baseband or as part of a carrier wave. Such a propagated signal may take any of a variety of forms, including, but not limited to, electromagnetic, optical, or any suitable combination thereof. A computer usable signal medium may be a computer usable medium that is not a computer usable storage medium and that can communicate, propagate, or transport a program for use by or in connection with an instruction execution system, apparatus, or device.

Program code embodied on a computer usable medium may be transmitted using any appropriate medium, including but not limited to wireless, wireline, optical fiber cable, RF, etc., or any suitable combination of the foregoing. Further, a computer storage medium may contain or store a computer-usable program code such that when the computer-usable program code is executed on a computer, the execution of this computer-usable program code causes the computer to transmit another computer-usable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code such as for controlling a hearing aid based on an adjustable policy. A client data processing system may download that computer usable code, such as for storing on a data storage medium associated with the client data processing system, or for using in the client data processing system. The server data processing system may similarly upload computer usable code from the client data processing system such as a content source. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

The terminology used herein is for the purpose of describing particular embodiments and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method of controlling a hearing aid based on an adjustable policy comprising:

receiving an input signal;

receiving an indication signal from a user identifying the input signal;

upon receiving the indication signal, sampling the input signal;

receiving an adjustment to the hearing aid with the indication signal;

utilizing a processor to store the sampled input signal in memory with the adjustment to the hearing aid as an adjustable policy corresponding to the sampled input signal;

receiving a second input signal;

periodically sampling the second input signal;

utilizing the processor to compare the sampled second input signal to a set of sampled input signals previously identified by the user including the sampled input signal, each of the set of sampled input signals having a corresponding adjustable policy;

utilizing the processor to determine whether the sampled second input signal matches one of the set of sampled input signals previously identified by the user; and upon a positive determination, providing the corresponding adjustable policy for controlling the hearing aid.

2. The method of claim 1 further comprising receiving an adjustment input from the user to adjust the adjustable policy upon occurrence of the matching sampled input signal.

3. The method of claim 1 further comprising utilizing a set of criteria to determine whether the sampled second input signal matches one of the set of sampled input signals previously identified by the user.

4. The method of claim 3 wherein the set of criteria are selected from a group consisting of sound detection, voice identification, electronic signals, infrared signals, magnetic signals, inductive signals and vibrations.

5. The method of claim 1 further comprising:

monitoring sampled input signals and corresponding adjustments;

storing the sampled input signals and the corresponding adjustments to form a history;

performing statistical analysis of the history; and updating at least one adjustable policy to reflect the statistical analysis.

6. The method of claim 1 further comprising:

providing a user interface allowing the user to create, modify, set, and change the at least one adjustable policy.

7. The method of claim 2 further comprising:

utilizing a set of criteria to determine whether the sampled second input signal matches one of the set of sampled input signals previously identified by the user;

monitoring sampled input signals and corresponding adjustments;

storing the sampled input signals and the corresponding adjustments to form a history;

performing statistical analysis of the history; and updating at least one adjustable policy to reflect the statistical analysis;

wherein the set of criteria are selected from a group consisting of sound detection, voice identification, electronic signals, infrared signals, magnetic signals, inductive signals and vibrations.

8. The method of claim 1 wherein the sampled input signal is compared to future input signals to determine whether to implement the adjustable policy upon a positive comparison.

* * * * *